US011065483B2

(12) United States Patent
Lee

(10) Patent No.: US 11,065,483 B2
(45) Date of Patent: Jul. 20, 2021

(54) SYSTEMS AND METHODS FOR FIRE CONTAINMENT

(71) Applicant: Randal A. Lee, Marble Falls, TX (US)

(72) Inventor: Randal A. Lee, Marble Falls, TX (US)

( * ) Notice: Subject to any disclaimer, the term of this patent is extended or adjusted under 35 U.S.C. 154(b) by 0 days.

(21) Appl. No.: 15/898,736

(22) Filed: Feb. 19, 2018

(65) Prior Publication Data

US 2018/0236279 A1 Aug. 23, 2018

Related U.S. Application Data

(60) Provisional application No. 62/460,446, filed on Feb. 17, 2017.

(51) Int. Cl.

| | |
|---|---|
| ***A62C 2/06*** | (2006.01) |
| ***A62C 99/00*** | (2010.01) |
| ***A62C 3/08*** | (2006.01) |
| *A62C 8/06* | (2006.01) |

(52) U.S. Cl.

CPC ..... *A62C 2/065* (2013.01); *A62C 3/08* (2013.01); *A62C 99/0009* (2013.01); *A62C 8/06* (2013.01)

(58) Field of Classification Search

CPC .. A62C 2/065; A62C 3/08; A62C 8/06; A62C 99/0009; E01H 1/1206; C09D 5/185; C08G 2150/60; A62B 17/003; A41D 31/085

USPC ..... 169/49

See application file for complete search history.

(56) References Cited

U.S. PATENT DOCUMENTS

| | | | | |
|---|---|---|---|---|
| 5,222,777 | A * | 6/1993 | Clonch | E01H 1/1206 294/1.3 |
| 9,469,440 | B1 * | 10/2016 | Flood | B65D 33/00 |
| 2002/0056713 | A1 * | 5/2002 | Rose | B32B 15/04 220/62.11 |
| 2012/0052217 | A1 * | 3/2012 | Monfalcone, III | D06M 23/00 428/7 |
| 2013/0280535 | A1 * | 10/2013 | Maas | A62C 2/065 428/412 |

* cited by examiner

*Primary Examiner* — Tuongminh N Pham

(74) *Attorney, Agent, or Firm* — Bell Nunnally & Martin LLP

(57) ABSTRACT

An apparatus for containing fires including a fire containment pouch that includes an upper portion and a lower portion, the fire containment pouch is a flame-resistant material. The upper portion includes a pouch section that is coated with an intumescent material and the lower portion including a cuff section. The upper portion and the lower portion juxtaposed one against each other to define an outer containment portion of elongate length from a top of the pouch section and a bottom of the cuff section. The fire containment pouch is adaptable to be pulled inside out thereby transforming the outer containment portion to an inner containment portion and a fastener secured to the bottom of the cuff section to seal an object within the inner containment portion after the fire containment pouch has been pulled inside out.

18 Claims, 4 Drawing Sheets

A-A

SYSTEMS AND METHODS FOR FIRE CONTAINMENT

CROSS-REFERENCE TO RELATED APPLICATIONS

This patent application claims priority from, and incorporates by reference the entire disclosure of, U.S. Provisional Patent Application No. 62/460,446 filed on Feb. 17, 2017.

BACKGROUND

Technical Field

The present disclosure relates generally to fire containment and more particularly, but not by way of limitation, to systems and methods for fire containment pouches.

History of the Related Art

As handheld electronic devices have proliferated, a record number of Lithium Ion ("Li-Ion") battery cells are being manufactured to power those devices. This number is only going to increase. Although Li-Ion batteries are widely used to power many different types of electronic devices, they are prone to fail. When a Li-Ion battery fails, one possible outcome is the battery catching fire. With a record number of battery cells in use, the number of battery cell fires will naturally increase. The number of cell phones being used on commercial flights is also increasing. In fact, there have been several incidents of batteries catching fire on aircrafts while inflight. In 2016, there were incidents of handheld electronic devices, such a SAMSUNG GALAXY NOTE 7, catching fire on board an aircraft during a flight. In each case, there was a flight disruption requiring an emergency landing.

Fire containment is an approach to controlling inflight fires that has been accepted by the aviation industry. For example, The Boeing Company adopted fire containment to solve their own on board battery fires on the DREAMLINER aircraft. Military pilots and aircrew wear flight suits made of a fire retardant material, such as NOMEX, to protect them from the possibility of cockpit fires and other mishaps. Wildland firefighters wear NOMEX shirts and trousers as part of their personal protective equipment during wildfire suppression activities. Race car drivers wear driving suits constructed of NOMEX and other fire retardant materials, along with NOMEX gloves, long underwear, balaclavas, socks, helmet linings and shoes to protect them in the event of a fire. Recently, troops riding in ground vehicles have also begun wearing NOMEX. NOMEX is a registered trademark for flame-resistant meta-aramid material developed by DuPont. NOMEX and related aramid polymers are related to nylon, but have aromatic backbones, and hence are more rigid and more durable. NOMEX has excellent thermal, chemical and radiation resistance properties for a polymer material. It is sold in both fiber and sheet forms and is used as a fabric wherever resistance from heat and flames are required. NOMEX Paper and MYLAR-NOMEX laminates are used extensively in aircraft construction to create clothing and equipment that can withstand intense heat. Aramid fibers are a class of heat-resistant and strong synthetic fibers. They are used in aerospace and military applications for ballistic-rated body armor fabric and ballistic composites, in bicycle tires and as an asbestos substitute. Fire protectant materials made from NOMEX often include a percentage of other materials, such as KEVLAR to provide added strength to the material. For example, KEVLAR thread may be used to hold the fabric together at the seams. Other flame retardant materials used either alone or in combination with NOMEX include KEVLAR, TWARON, silica gels, cellulose fibers, MYLAR, MARLAN and other flame retardant fabrics and films.

When a fires occurs inflight in an aircraft, seconds count with the containment of that fire. A quick containment of the fire may allow for no flight disruption. Therefore, a low cost, lightweight, fire containment system that is available for use within seconds of a fire starting on a flight is needed.

SUMMARY OF THE INVENTION

An apparatus for containing fires including a fire containment pouch that includes an upper portion and a lower portion, the fire containment pouch is a flame-resistant material. The upper portion includes a pouch section that is coated with an intumescent material and the lower portion including a cuff section. The upper portion and the lower portion juxtaposed one against each other to define an outer containment portion of elongate length from a top of the pouch section and a bottom of the cuff section. The fire containment pouch is adaptable to be pulled inside out thereby transforming the outer containment portion to an inner containment portion and a fastener secured to the bottom of the cuff section to seal an object within the inner containment portion after the fire containment pouch has been pulled inside out.

An apparatus for containing fires including a fire containment pouch that includes an upper portion and a lower portion, the fire containment pouch is a flame-resistant material. The upper portion includes a pleated end, the upper portion and the pleated end is coated with an intumescent material. The pleated end having a quilted liner and the lower portion includes a cuff section. The cuff section includes a flame-resistant material. The upper portion and the lower portion juxtaposed one against each other to define an outer containment portion of elongate length from a top of the upper portion and a bottom of the lower portion. The fire containment pouch is adaptable to be pulled inside out thereby transforming the outer containment portion to an inner containment portion and a fastener secured to the bottom of the cuff section to seal an object within the inner containment portion after the fire containment pouch has been pulled inside out.

A method of containing a fire including unfolding a cuff of a fire containment pouch, inserting a hand into the fire containment pouch, picking up an object on fire, removing the fire containment pouch while holding the object, such that the fire containment pouch is turned inside out, sealing the fire containment pouch and compressing the fire containment pouch to cause a molding within the fire containment pouch to form around the object, thereby depriving the fire of air.

BRIEF DESCRIPTION OF THE DRAWINGS

A more complete understanding of the method and apparatus of the present disclosure may be obtained by reference to the following Detailed Description when taken in conjunction with the accompanying Drawings wherein.

DETAILED DESCRIPTION

In accordance with the present disclosure, systems and methods for fire containment are shown and described below. In accordance with one aspect of the present disclosure, a description of a design of an inexpensive, lightweight, fire containment system suitable to contain cell phone, or other portable electronic device, fires is provided herein.

In various embodiments, a fire containment system can include a fire containment pouch designed to fit within the seatback pocket on an airplane. To use the pouch, a user can unfold a cuff portion of the pouch and place a hand inside a liner. The user can then pick up a flaming cell phone, or other electronic device, grab the cuff of the pouch and can then turn the pouch inside out as the pouch is removed from the hand. The user can then pull on a drawstring and cinch a clasp to deprive the fire of air.

In some embodiments, the pouch may be formed of a fire resistant material, such as NOMEX, and may have a fire retardant lining. In various embodiments, the fire retardant lining may include an intumescent material that may be moldable around the cell phone or other electronic device to enhance the fire containment.

Figure 1:
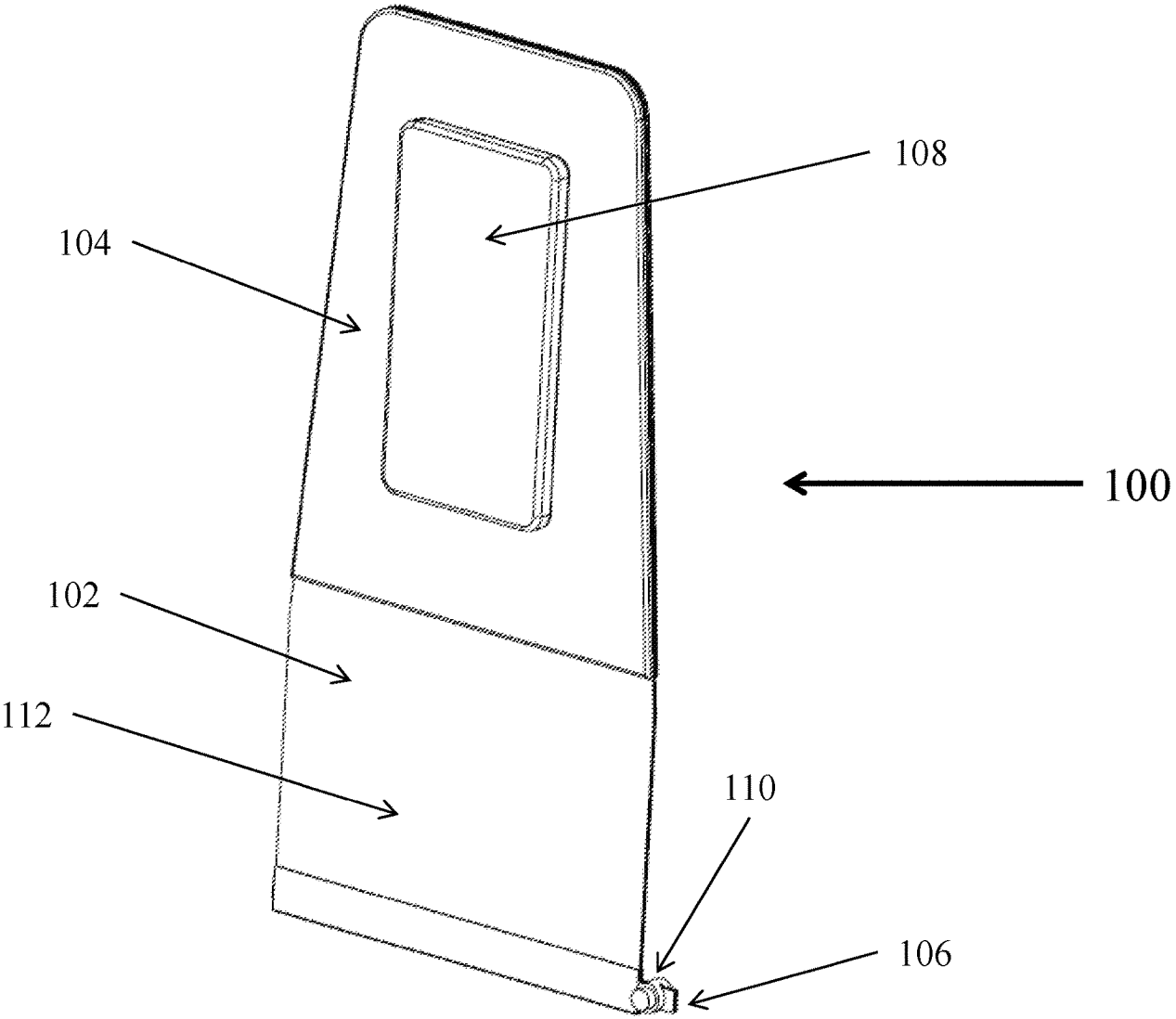
FIG. 1 illustrates a fire containment pouch of one embodiment of the present disclosure.

FIG. 1 illustrates a fire containment pouch 100 of one embodiment of the present disclosure. The fire containment pouch 100 can include a cuff 112 and a pouch 104. The fire containment pouch 100 may be formed of two halves 102 made of, for example, NOMEX. The surface of each half of the pouch 104 may be coated with intumescent material, such as, for example, 3M FIREDAM SPRAY 200, or other intumescent material typically used in passive fire protection. The intumescent coating can be applied to the exterior surface of the pouch 104, such that, when a cell phone 108 is picked up and the fire containment pouch 100 is turned inside out, the intumescent material swells as a result of the heat exposure, thereby increasing in volume and decreasing in density. These intumescent materials can produce a light char, which is a poor conductor of heat, thus retarding heat transfer. In some embodiments, the light char may consist of microporous carbonaceous foam formed by a chemical reaction of, for example, ammonium polyphosphate, pentaerythritol and melamine. These reactions can take place in a matrix formed by the molten binder, which can be based on vinyl acetate copolymers or styrene acrylates. The type and thickness of the coating on the pouch 104 can be varied to increase the containment rating. Multiple coatings of different intumescent or fire retarding materials may be applied to increase the fire containment rating. In the embodiment shown, the cuff 112 is in an unfolded state. The cuff 112 may be folded around the pouch 104 when not in use to save space while being stored, for example, in the backseat pocket on a commercial aircraft, and to protect the intumescent material. In some embodiments, the cuff 112 can be pleated and folded when stored. When the cuff 112 is pleated, the cuff 112 is allowed to open up larger to facilitate the turning of the fire containment pouch 100 inside out.

Figure 2A:
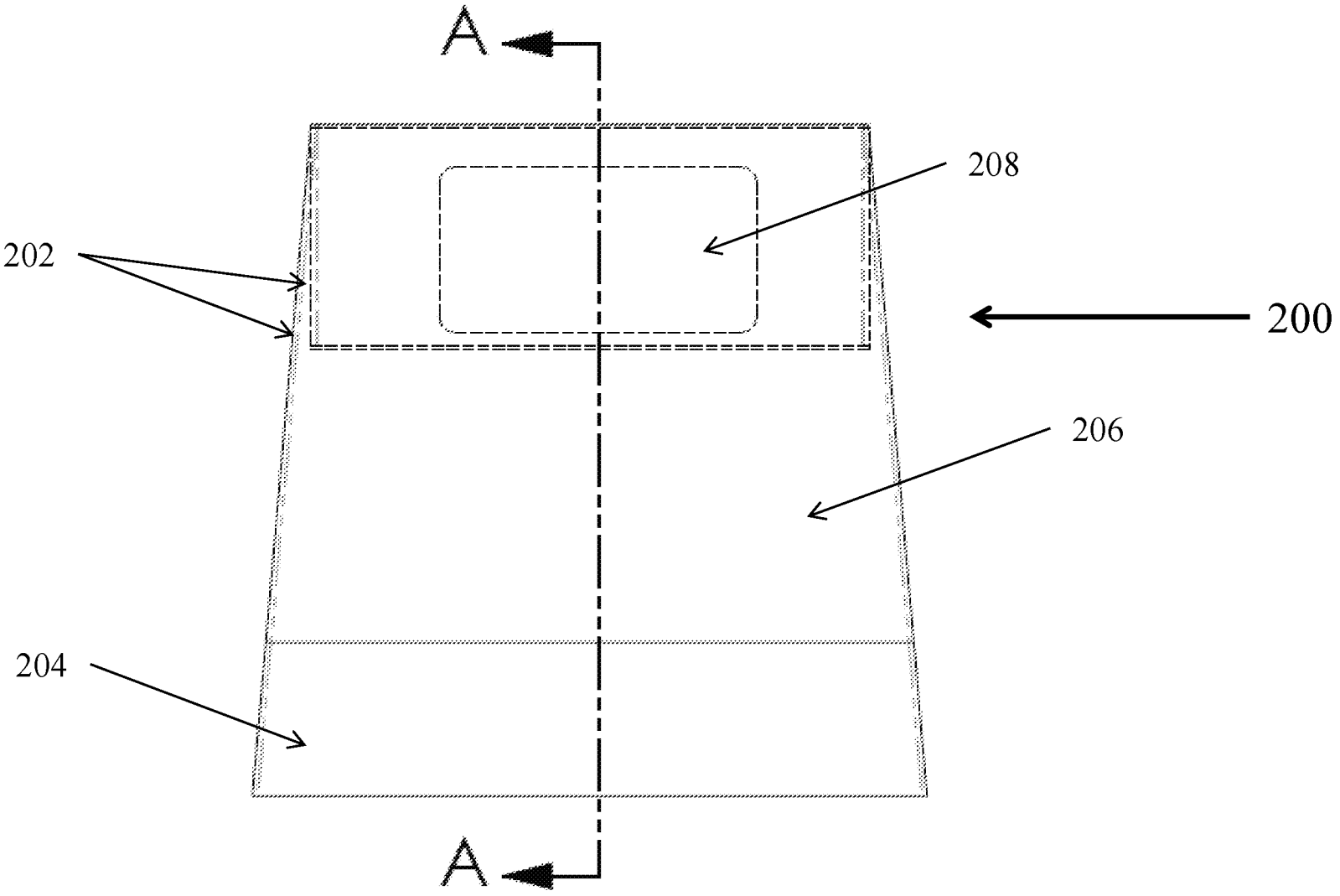
FIG. 2A illustrates a view of an alternative embodiment of a fire containment pouch.
Figure 2B:
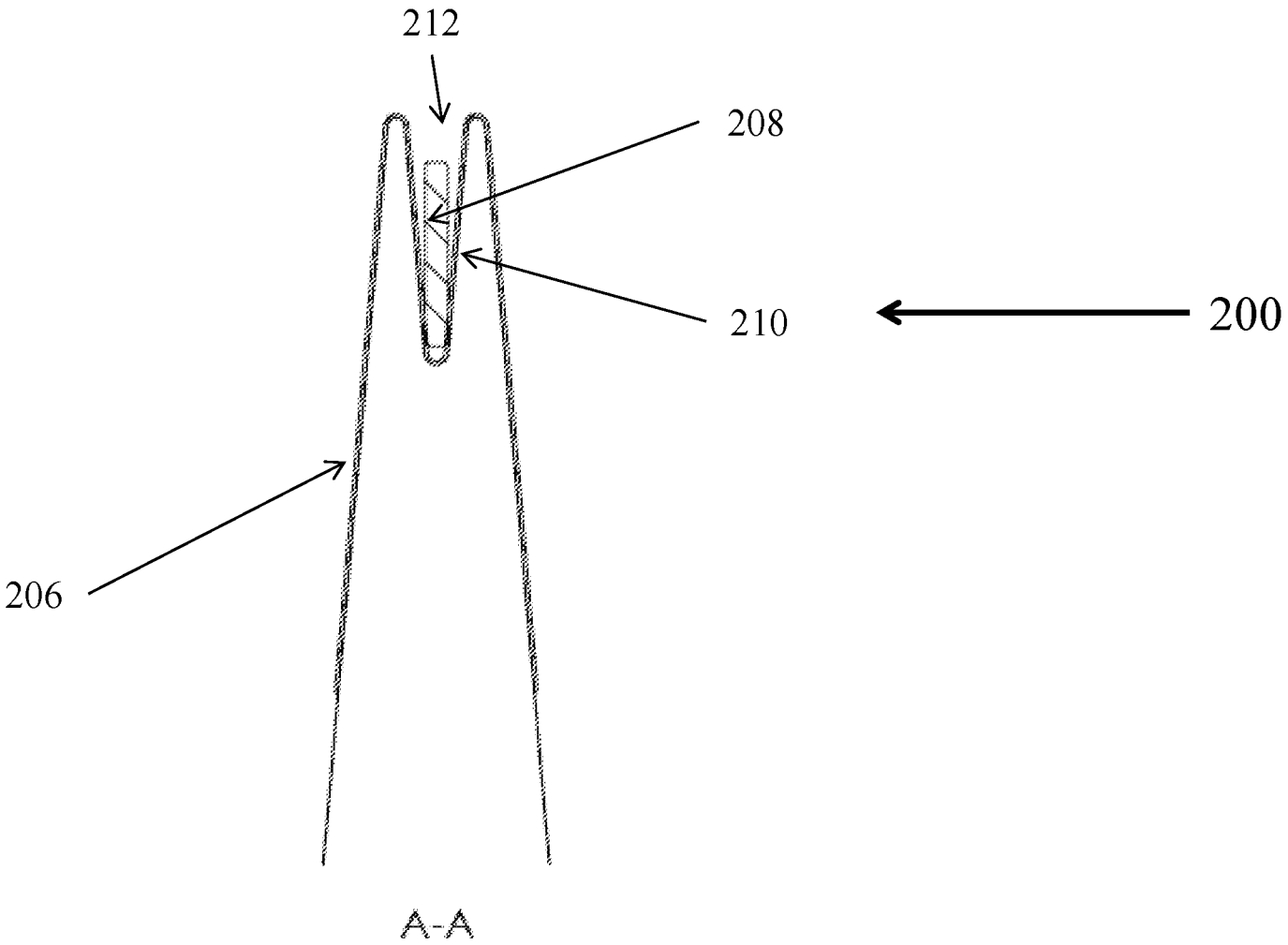
FIG. 2B illustrates a side sectional view of the fire containment pouch according to the embodiment depicted in FIG. 2A.
Figure 3:
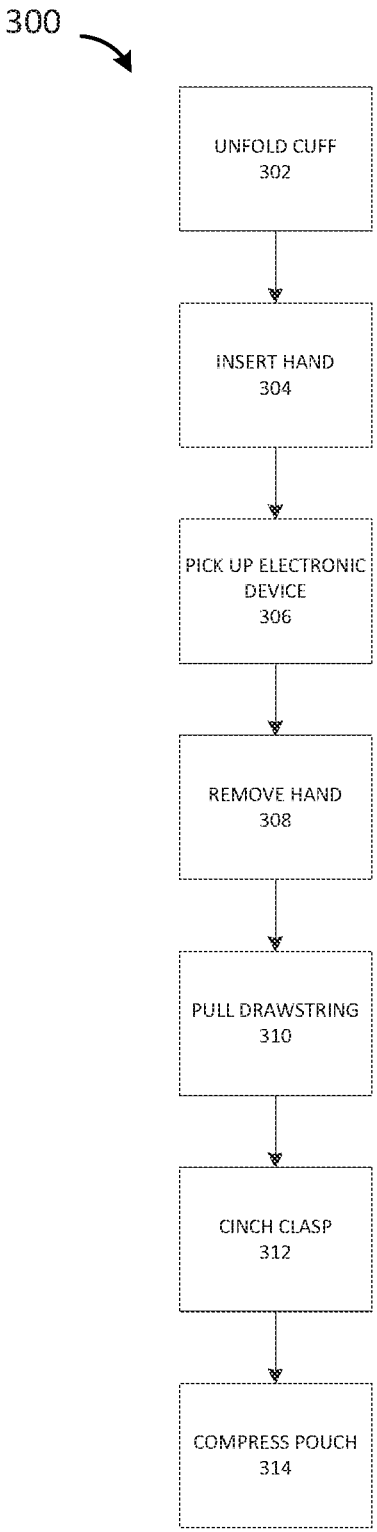
FIG. 3 illustrates an example process for fire containment utilizing a fire containment pouch.

In accordance with the present disclosure, a method for fire containment using the fire containment pouch 100 is described and will be illustrated in fuller detail with regard to FIG. 3. In accordance with one aspect of the present disclosure, the method can include an inexpensive lightweight fire containment system suitable to contain cell phone and/or other portable electronic device fires, for example the fire containment pouch 100. A user can unfold the cuff 112 portion of the fire containment pouch 100 and place a hand inside the pouch 104 of the fire containment pouch 100. The user can then pick up an electronic device, for example, the cell phone 108, that has caught fire and grab the cuff 112 of the fire containment pouch 100 and, while still holding the cell phone 108, can turn the fire containment pouch 100 inside out as the fire containment pouch 100 is removed from the hand. The user can then pull on a drawstring 106 and cinch a clasp 110, thereby depriving the fire of air and mold the intumescent materials of the pouch 104 closer to the cell phone 108. In some embodiments the drawstring 106 can be made of NOMEX. In various embodiments, the containment method utilizes two pieces a self-extinguishing material, for example, a NOMEX cloth to form the pouch 104. Inside the pouch 104 there can be two liners that are sewn onto the inner surface of each of the NOMEX pouch halves. In various embodiments, the two halves 102 of the fire containment pouch 100 may be stitched together with a fire resistant thread, such as KEVLAR and/or NOMEX or similar material. The pouch halves and liner are sewn together to form the fire containment pouch 100 and the pouch 104. In some embodiments, the length of the pouch 104 may be approximately two or three times the length of an electronic device to be contained. The length can allow for the cell phone 108 to fold in the material as the fire containment pouch 100 is turned inside out during usage. Once the fire containment pouch 100 is turned inside out, the drawstring 106, with the clasp 110, can be used to close and seal the open end of the fire containment pouch 100 thereby denying the fire air. Once inside out, containment can be improved if the perimeter of the pouch 104 is compressed, molding the two halves of intumescent material together around a device, for example, the cell phone 108. This can drive air away from the fire and sink heat from the fire. In some embodiments, the pouch 104 can be folded to reduce the size when stowed. In various embodiments, a mold release coating may be applied to the cuff 112 below the pouch 104, so that the intumescent layer on the pouch 104 does not stick and/or transfer to the cuff 112 when in the stowed position. In other embodiments, once the fire containment pouch 100 is pulled inside out it can then be rolled up, thereby forming the intumescent material around the phone and removing air from the fire containment pouch 100. The fire containment pouch 100 can then secured with hook and loop fasteners or via the drawstring 106 and clasp 110 to maintain containment. In some embodiments, a draft angle on the fire containment pouch 100 can facilitate the turning inside out, for example, a five degree draft angle per side. In some embodiments, pleats can be used between the NOMEX layers to facilitate the turning of the fire containment pouch 100 inside out, as will be described in more detail below with respect to FIGS. 2A-B. The size, weight, and cost of the fire containment pouch 100, depending on the various embodiments, may be reduced to approximately the cost of, for example, an inflight magazine on an airplane.

In some embodiments, the drawstring 106 and clasp 110 can be substituted for a hook and loop closure that can include two lineal fabric strips which are attached, sewn, stitched and/or otherwise adhered to the cuff 112 to thereby be on opposing surfaces after the fire containment pouch 100 has be turned inside out, such that the hook and look closure can be utilized to fasten, close and seal the open end of the fire containment pouch 100 thereby denying the fire air. The hook and loop lineal fabric strips can include a first component featuring tiny hooks and a second component featuring even smaller and/or "hairier" loops. When the two components are pressed together, the hooks catch in the loops and the two pieces fasten and/or bind during the time that they are pressed together.

FIGS. 2A-B illustrates a fire containment pouch 200 of one embodiment of the present disclosure having an end pleat 212. The fire containment pouch 200 can include a cuff 204 made from two pieces of a self-extinguishing material, for example, a NOMEX cloth. The surface portion above the cuff 204 may be coated with intumescent material, such as, for example, 3M FIREDAM SPRAY 200, or other intumescent material typically used in passive fire protection, to form an intumescent coating 206. The intumescent coating 206 can be applied to the exterior surface of the pouch, such that, when a cell phone 208, or other electronic device, is picked up and the fire containment pouch 200 is turned inside out, the intumescent material swells as a result of the heat exposure, thereby increasing in volume and decreasing in density. These intumescent materials can produce a light char, which is a poor conductor of heat, thus retarding heat transfer. In some embodiments, the light char may consist of microporous carbonaceous foam formed by a chemical reaction of, for example, ammonium polyphosphate, pentaerythritol and melamine. These reactions can take place in a matrix formed by the molten binder which can be based on vinyl acetate copolymers or styrene acrylates. The type and thickness of the intumescent coating 206 can be varied to increase the containment rating. Multiple coatings of different intumescent and/or fire retarding materials may be applied to increase the fire containment rating. In some embodiments, the cuff 204 can be pleated and folded when stored. When the cuff 204 is pleated, the cuff 204 is allowed to open up larger to facilitate the turning of the fire containment pouch 200 inside out.

As shown in the side view in FIG. 2B, section A-A, the end pleat 212 has been stitched, via stitches 202, to an end of the fire containment pouch 200. In various embodiments, the stitches 202 are formed with a fire resistant thread, such as KEVLAR and/or NOMEX or similar material. A quilted liner 210 can be on the inside and/or outside of the fire containment pouch 200 to provide a thermal break and/or barrier to dampen or eliminate heat from reaching the hand and fingers of a user. In operation, a user can insert a hand into the fire containment pouch 200, inserting a thumb and fingers on either side of the end pleat 212. The cell phone 208 can then be grabbed and held in place while the fire containment pouch 200 is turned inside-out to enclose the cell phone 208.

FIG. 3 illustrates an example process 300 for fire containment utilizing a fire containment pouch, for example, the fire containment pouch 100. At block 302 a user can unfold the cuff 112 portion of the fire containment pouch 100. At block 304 the user can insert their hand into the pouch 104 of the fire containment pouch 100. In some embodiments, the fire containment pouch 100 is lined with an insert to allow for better accessibility and/or the insertion of the hand. In some embodiments, the lined insert can take the form of a hand, mitt, glove and the like. At block 306 the user picks up an electronic device that has caught fire, for example, the cell phone 108. At block 308, while the user is still holding the electronic device, the user can turn the fire containment pouch 100 inside out as the fire containment pouch 100 is removed from the hand. At block 310, once the fire containment pouch 100 is turned inside out, the user can then pull the drawstring 106. In some embodiments, the drawstring 106 can be made of NOMEX. At block 312 the user cinches the clasp 110 causing the fire containment pouch 100 to close and seal with the electronic device inside, thereby depriving the fire of air and molding the intumescent materials of the pouch 104 closer to the electronic device. In some embodiments, the drawstring 106 and clasp 110 can be substituted for a hook and loop closure that can include two lineal fabric strips which are attached, sewn, stitched and/or otherwise adhered to the cuff 112 to thereby be on opposing surfaces after the fire containment pouch 100 has be turned inside out, such that the hook and look closure can be utilized to fasten, close and seal the open end of the fire containment pouch 100 thereby denying the fire air. At block 314 the user can then compress the perimeter of the pouch 104 which causes the molding of the two halves of intumescent material together around the electronic device. In various embodiments, the compression of the perimeter of the pouch 104 drives air away from the fire and sinks heat from the fire. The compression at the block 314 can also be achieved by rolling up the fire containment pouch 100, thereby forming the intumescent material around the phone and removing air from the fire containment pouch 100.

It is further contemplated that the materials and designs used in this discloser could further be utilized to form electronic cases, for example, cell phone cases, tablet cases, portable computer cases and/or other electronic device cases. The cases envisioned could also include similar functionality as the containment devices described above, such that the cases could be utilized to have fire containment built into the cases. These cases could then be certified as "ready to fly" to indicate that the electronic device has a case that is designed to contain fires in the event of a battery fire and/or other various electronic failures that could result in a fire.

Although various embodiments of the method and apparatus of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit and scope of the invention.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features and/or elements. Thus, such conditional language is not generally intended to imply that features and/or elements are in any way required for one or more embodiments.

What is claimed is:

1. An apparatus for containing fires comprising:

a fire containment pouch comprising an upper portion and a lower portion, wherein the fire containment pouch is a flame-resistant material;

the upper portion comprising a pouch section having a closed end and an open end, wherein at least a portion of the pouch section is coated with an intumescent material;

the lower portion comprising a cuff section having a top and a bottom, the cuff section being open on the top and the bottom thereof;

the open end of the pouch section of the upper portion and the top of the cuff section of the lower portion juxtaposed one against each other to define an outer containment portion of elongate length from the closed end of the pouch section to the bottom of the cuff section;

wherein the bottom of the cuff section is configured to be folded around the upper portion such that a surface of the cuff section covers at least a portion of the pouch section to thereby protect the intumescent material when not in use;

the fire containment pouch adaptable to be pulled inside out thereby transforming the outer containment portion to an inner containment portion;

a fastener secured to the bottom of the cuff section to seal an object within the inner containment portion after the fire containment pouch has been pulled inside out; and wherein the intumescent material may be molded around the object after the fire containment pouch has been pulled inside out to enhance fire containment.

2. The apparatus of claim 1, wherein the fastener comprises a drawstring and a clasp fastener.

3. The apparatus of claim 2, wherein the drawstring is comprised of intumescent materials.

4. The apparatus of claim 1, wherein the fastener comprises a hook and loop fastener.

5. The apparatus of claim 1, wherein the cuff section comprises a mold release coating.

6. The apparatus of claim 1, wherein the fire containment pouch comprises multiple layers of self-extinguishing materials.

7. The apparatus of claim 1, wherein the cuff section is pleated.

8. The apparatus of claim 1, wherein the intumescent material produces a light char upon heat exposure.

9. The apparatus of claim 1, wherein the surface of the cuff section has a coating applied thereto to prevent the intumescent layer from sticking to the surface of the cuff section.

10. An apparatus for containing fires comprising:

a fire containment pouch comprising an upper portion and a lower portion, wherein the fire containment pouch is a flame-resistant material;

the upper portion having a closed pleated end and an open end opposite thereof, wherein the pleated end is coated with an intumescent material on a first surface thereof;

the pleated end having a liner on a second surface thereof opposite the first surface;

the lower portion comprising a cuff section having an open top end and an open bottom end, wherein the cuff section comprises a flame-resistant material;

the open end of the upper portion and the open top end of the cuff section of the lower portion juxtaposed one against each other to define an outer containment portion of elongate length from the pleated end of the upper portion to the open bottom end of the cuff section of the lower portion;

wherein the lower portion is configured to be folded around the upper portion such that a surface of the cuff section covers at least a portion of the pleated end;

the fire containment pouch adaptable to be pulled inside out thereby transforming the outer containment portion to an inner containment portion;

a fastener secured to the open bottom end of the cuff section to seal an object within the inner containment portion after the fire containment pouch has been pulled inside out; and wherein the intumescent material may be molded around the object after the fire containment pouch has been pulled inside out to enhance fire containment.

11. The apparatus of claim 10, wherein the fastener comprises a drawstring and a clasp fastener.

12. The apparatus of claim 11, wherein the drawstring comprises intumescent materials.

13. The apparatus of claim 10, wherein the fastener comprises a hook and loop fastener.

14. The apparatus of claim 10, wherein the cuff section comprises a mold release coating.

15. The apparatus of claim 10, wherein the fire containment pouch comprises multiple layers of self-extinguishing materials.

16. The apparatus of claim 10, wherein the cuff section is pleated.

17. The apparatus of claim 10, wherein the intumescent material produces a light char upon heat exposure.

18. The apparatus of claim 10, wherein the liner provides a thermal break.

* * * * *